US012379164B2

(12) United States Patent
Duerr et al.

(10) Patent No.: US 12,379,164 B2
(45) Date of Patent: Aug. 5, 2025

(54) EVAPORATOR

(71) Applicant: MAHLE International GmbH, Stuttgart (DE)

(72) Inventors: Gottfried Duerr, Ludwigsburg (DE); Guenther Feuerecker, Stuttgart (DE)

(73) Assignee: Mahle International GmbH, Stuttgart (DE)

( * ) Notice: Subject to any disclaimer, the term of this patent is extended or adjusted under 35 U.S.C. 154(b) by 248 days.

(21) Appl. No.: 18/136,073

(22) Filed: Apr. 18, 2023

(65) Prior Publication Data

US 2023/0332836 A1 Oct. 19, 2023

(30) Foreign Application Priority Data

Apr. 19, 2022 (DE) ..... 10 2022 203 829.0

(51) Int. Cl.
*F28F 9/02* (2006.01)
*F25B 39/02* (2006.01)
*F28D 7/16* (2006.01)

(52) U.S. Cl.
CPC ..... *F28D 7/16* (2013.01); *F25B 39/02* (2013.01); *F28F 9/02* (2013.01)

(58) Field of Classification Search
CPC ..... F28D 7/16; F28B 39/02; F28F 9/02
See application file for complete search history.

(56) References Cited

U.S. PATENT DOCUMENTS 9,919,584 B2 * 3/2018 Lee ..... F25B 39/02

FOREIGN PATENT DOCUMENTS

DE 102018209775 A1 12/2019

* cited by examiner

*Primary Examiner* — Davis D Hwu
(74) *Attorney, Agent, or Firm* — Muncy, Geissler, Olds & Lowe, P.C.

(57) ABSTRACT

An evaporator for a refrigerant circuit, in particular of a motor vehicle, with a tube/fin block with a multiplicity of tubes and fins, with a first collecting tank on one side of the tube/fin block and with a second collecting tank on the other side of the tube/fin block. The first collecting tank has an inlet chamber and an outlet chamber, wherein the inlet chamber is provided with a refrigerant inlet connection and the outlet chamber is provided with a refrigerant outlet connection, wherein a first baffle and a second baffle are arranged in the inlet chamber, which baffles are arranged spaced apart from one another in the inlet chamber.

15 Claims, 2 Drawing Sheets

EVAPORATOR

This nonprovisional application claims priority under 35 U.S.C. § 119(a) to German Patent Application No. 10 2022 203 829.0, which was filed in Germany on Apr. 19, 2022, and which is herein incorporated by reference.

BACKGROUND OF THE INVENTION

Field of the Invention

The invention relates to an evaporator for a refrigerant circuit of a motor vehicle.

Description of the Background Art

DE 10 2018 209 775 A1 discloses an evaporator for a refrigerant circuit of a motor vehicle, in which the evaporator has a tube/fin block with a multiplicity of tubes, and the evaporator is designed with a first collecting tank on one side of the tube/fin block and with a second collecting tank on the other side of the tube/fin block in such a manner that the first collecting tank has an inlet chamber and an outlet chamber, wherein the inlet chamber is provided with a refrigerant inlet connection and the outlet chamber is provided with a refrigerant outlet connection, wherein the first collecting tank optionally has additional deflection chambers, wherein the second collecting tank has deflection chambers for deflecting refrigerant from one group of tubes to another group of tubes of the tube/fin block.

In the prior art evaporator, the first collecting tank and the second collecting tank are arranged essentially horizontally, wherein the first collecting tank is arranged on the evaporator at the bottom and the second collecting tank is arranged at the top and above the first collecting tank. As a result, the inlet chamber with the refrigerant inlet connection and the outlet chamber with the refrigerant outlet connection are arranged at the bottom. While this arrangement does have advantages with regard to space in some installation situations, the superheating often is insufficient and inadequate. If the evaporator is turned around so that the inlet chamber with the refrigerant inlet connection and the outlet chamber with the refrigerant outlet connection are arranged at the top, result in low-load operation is a strongly unequal distribution of the liquid phase of the refrigerant, which leads to impermissibly large hot zones in the air outlet temperature at the tube/fin block.

Furthermore, the demand that significantly superheated operation should be possible even at low load is being made with increasing frequency, especially in the case of electrically driven motor vehicles.

SUMMARY OF THE INVENTION

It is therefore an object of the invention to provide an evaporator that has a uniform temperature profile over the entire operating range and nonetheless achieves high superheating in low-load operation.

An exemplary embodiment of the invention relates to an evaporator for a refrigerant circuit, in particular of a motor vehicle, with a tube/fin block with a multiplicity of tubes and fins, with a first collecting tank on one side of the tube/fin block and with a second collecting tank on the other side of the tube/fin block, the first collecting tank has an inlet chamber and an outlet chamber, wherein the inlet chamber is provided with a refrigerant inlet connection and the outlet chamber is provided with a refrigerant outlet connection, wherein a first baffle and a second baffle are arranged in the inlet chamber, which baffles are arranged spaced apart from one another in the inlet chamber. This achieves the result that, on account of the baffles, the flow velocity of the refrigerant is sufficiently great, and the throw distance of the refrigerant is sufficiently great to reach the end of the inlet chamber in the lateral direction, even in low-load operation, so that the refrigerant is uniformly distributed over the tubes that are fluidically connected to the inlet chamber. This also makes it possible to prevent an underpressure in the inlet chamber directly after the first baffle, an occurrence that would be disadvantageous because it could reverse the flow velocity in tubes of the tube/fin block. A uniform temperature profile is thus achieved in high-load operation as well as in low-load operation.

The first baffle can be formed by a first wall with at least one first opening formed in the first wall and/or the second baffle is formed by a second wall with at least one second opening formed in the second wall. As a result, the flow of the fluid or of the refrigerant can be suitably modulated by requirement-oriented selection of the size and/or arrangement of the at least one first opening as well as the size and/or arrangement of the at least one second opening.

It is especially useful when the at least one first opening has a first opening cross-sectional area and the at least one second opening has a second opening cross-sectional area, wherein the first opening cross-sectional area is smaller than the second opening cross-sectional area. This advantageously also applies when multiple first openings are provided, such as, e.g., two, three, or four or more first openings. The distribution of the first openings can also be chosen advantageously, such as, e.g., in a triangular arrangement in the case of three first openings.

The at least one first opening can have an essentially circular or otherwise shaped opening or multiple circular openings and/or the at least one second opening is or has at least one or more essentially angular, as in particular quadrilateral, rectangular, square, or otherwise shaped opening. Thus, for example, three first openings can be provided in a triangular arrangement and a second opening can be designed in a quadrilateral shape, for example.

Multiple first openings can be provided that are equal in size and/or different in size with respect to the first opening cross-sectional area. Thus, for example, three first openings can be provided in a triangular arrangement, wherein the three first openings can each be equal in size or different in size, wherein, for example, two first openings can also be equal in size and one first opening can be larger or smaller than the other two first openings. A second opening can also be provided, for example.

The one first opening can align with the one second opening. As a result, a defined quantity of refrigerant can flow from the one first opening through the second opening.

It is advantageous as well when the one first opening on the first baffle is not covered at least partially by a projection of the second baffle. Nearly free flow through the second baffle can take place in this way.

It is also advantageous when the two first openings do not align with the second opening. Consequently, the refrigerant that flows therethrough is preferentially conducted into the tubes ahead of the second baffle.

The two first openings on the first baffle can be covered by a projection of the second baffle. Consequently, the refrigerant that flows therethrough is preferentially conducted into the tubes ahead of the second baffle.

The first collecting tank can project laterally past the tube/fin block with an overhang, and the first collecting tank can be divided in such a manner into an overhang region and a core region, wherein the overhang region projects laterally past the tube/fin block and the core region is located in the lateral extent of the tube/fin block. As a result, the overhang region can be used for the connection arrangement, by way of example, while the core region can be intended for the deflection in the region of the tube/fin block.

In addition, the refrigerant inlet connection of the inlet chamber and/or the refrigerant outlet connection of the outlet chamber can be arranged in the overhang region of the first collecting tank. A space-saving arrangement is permitted by this means.

The first baffle can be arranged in the inlet chamber at the transition between the transition region and the core region. As a result, a good distribution of the fluid, such as the refrigerant, over the tubes of the tube/fin block can be achieved so that the fluid is distributed over all of the tubes that are connected to the inlet chamber. In this way, a good throw distance of the fluid is achieved in order to achieve uniform distribution over the tubes.

The second baffle can be arranged in the inlet chamber in the core region. As a result, a sort of restrictor plate is achieved, which compensates for the pressure increase caused by the first baffle and also restrains liquid medium such as refrigerant.

The inlet chamber can have a lateral extent X, wherein the distance between the first baffle and the second baffle in proportion to the lateral extent X is in the range from 0.15 to 0.36, in particular is in the range from 0.21 to 0.33. The effect of the second baffle in proportion to the first baffle is achieved well as a result.

The inlet chamber and the tube/fin block can be designed and connected to one another in such a manner that a number N of tube ends of the tube/fin block project into the inlet chamber, or the inlet chamber is fluidically connected to a number N of tube ends of the tube/fin block, wherein the number M of tube ends between the first baffle and the second baffle in proportion to N is in the range from 0.15 to 0.36, in particular is in the range from 0.21 to 0.33. The effect of the second baffle in proportion to the first baffle is also achieved well by this means.

The first collecting tank can be arranged above the second collecting tank.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

The invention relates to an evaporator 1 for a refrigerant circuit, in particular of a motor vehicle.

Figure 1:
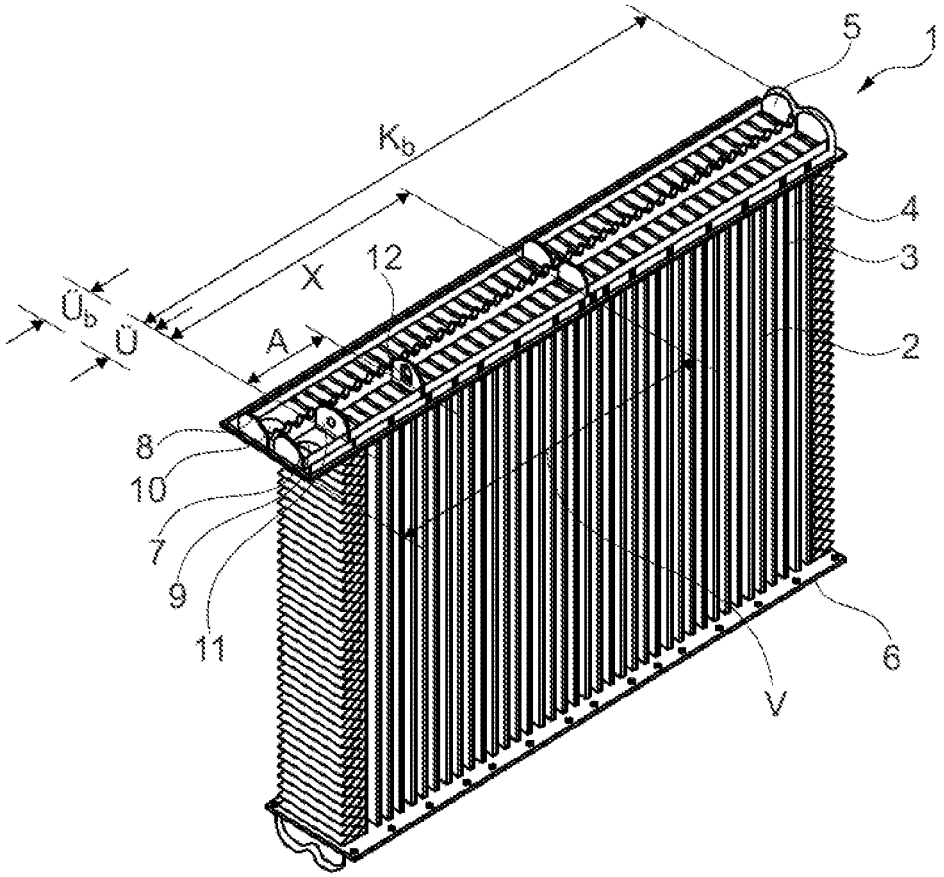
FIG. 1 is a schematic partial representation of an example of an evaporator according to the invention.
Figure 2:
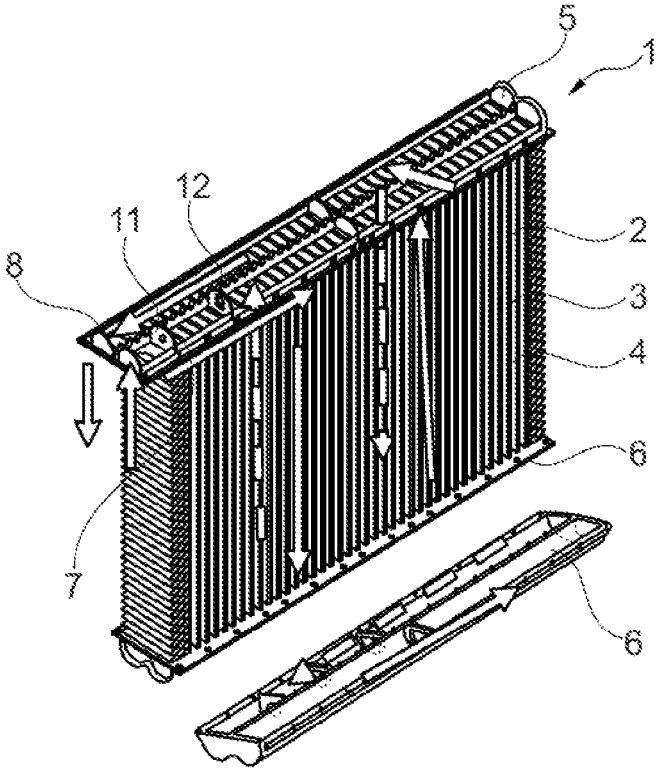
FIG. 2 is another schematic partial representation of the evaporator from FIG. 1.

The evaporator 1 is shown schematically in a partial representation in each of FIGS. 1 and 2.

The evaporator has a tube/fin block 2 with a multiplicity of tubes 3 and fins 4.

In addition, the evaporator has a first collecting tank 5 on one side of the tube/fin block 2 and a second collecting tank 6 on the other side of the tube/fin block 2.

The first collecting tank 5 can, by way of example, be arranged above the second collecting tank 6 or, alternatively, below the second collecting tank 6.

The first collecting tank 5 has an inlet chamber 7 and an outlet chamber 8. In addition, the inlet chamber 7 is provided with a refrigerant inlet connection 9. The outlet chamber 8 is provided with a refrigerant outlet connection 10. An inlet pipe is preferably connected, as for example soldered, to the refrigerant inlet connection 9, and an outlet pipe is preferably connected, as for example soldered, to the refrigerant outlet connection 10.

Figure 3:
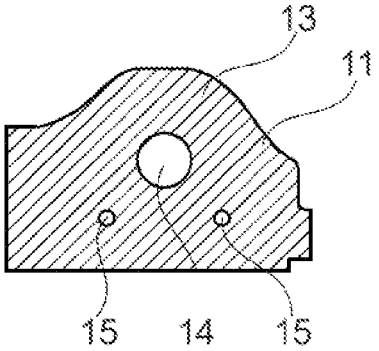
FIG. 3 is a view of the first baffle with three first openings.
Figure 5:
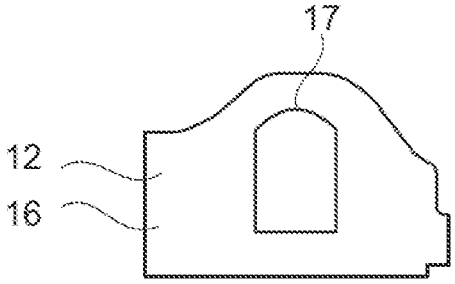
FIG. 5 is a view of an alternative second baffle with an alternative second opening.
Figure 4:
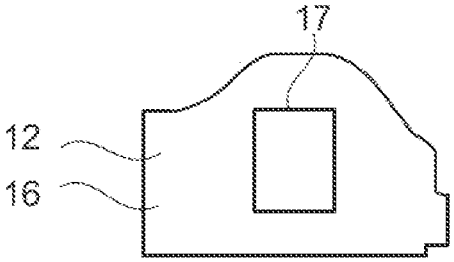
FIG. 4 is a view of the second baffle with a second opening.

As is shown in FIGS. 1 and 2, arranged in the inlet chamber 7 are a first baffle 11 and a second baffle 12, which are arranged spaced apart from one another in the inlet chamber 7, and which are also shown in FIGS. 3 and 4 or 5.

It is evident here, see FIG. 3, that the first baffle 11 is formed by a first wall 13 with at least one first opening 14, 15 formed in the first wall 13. In the exemplary embodiment shown, three first openings 14, 15 are provided. These three openings 14, 15 are arranged in a triangular arrangement, wherein two smaller openings 15 are arranged at the bottom and a larger opening 14 is at the top between the two smaller openings 15.

The second baffle 12 is formed by a second wall 16 with at least one second opening 17 formed in the second wall 16, see FIG. 4 or 5.

It is especially useful when the at least one first opening 14, 15 has a first opening cross-sectional area and the at least one second opening 17 has a second opening cross-sectional area, wherein the first opening cross-sectional area is smaller than the second opening cross-sectional area. This also applies by way of example to the sum of the first opening cross-sectional areas of the first openings 14, 15.

It is also evident that the at least one first opening 14, 15 forms an essentially circular opening or alternatively forms an otherwise shaped opening, for example also forms or has multiple circular openings 14, 15 as shown.

The at least one second opening 17 forms or has at least one or more essentially angular, as in particular quadrilateral, rectangular, square, or otherwise shaped opening 17. In the exemplary embodiment shown, the second opening 17 is angular with four corners, wherein three straight sides are provided and one curved side of the opening 17 is provided. The curved side follows the outer contour of the second wall 16 in this case, see FIG. 5. The second opening 17 in this case can also be designed with four straight sides, such as is shown in FIG. 4, for example.

It is fundamentally possible for multiple first openings 14, 15 to be provided that are equal in size and/or different in size with respect to the first opening cross-sectional area. In the exemplary embodiment shown, the first openings 15 are smaller than the first opening 14.

It is also evident from FIGS. 1 and 2 that the first collecting tank 5 projects laterally past the tube/fin block 2 with an overhang Ü, and the first collecting tank 5 can be divided in such a manner into an overhang region $Ü_b$ and a core region $K_b$, wherein the overhang region $Ü_b$ projects laterally past the tube/fin block 2 and the core region $K_b$ is located in the lateral extent of the tube/fin block 2.

The refrigerant inlet connection 9 of the inlet chamber 7 and/or the refrigerant outlet connection 10 of the outlet chamber 8 are arranged in the overhang region $Ü_b$ of the first collecting tank 5.

The first baffle 11 in this case is arranged in the inlet chamber 7 at the transition between the transition region $Ü_b$ and the core region $K_b$.

The second baffle 12 is arranged in the inlet chamber 7 in the core region $K_b$.

In this case, the inlet chamber 7 in the core region $K_b$ has a lateral extent X, wherein the distance A between the first baffle 11 and the second baffle 12 in proportion to the lateral extent X is in the range from 0.15 to 0.36, in particular is in the range from 0.21 to 0.33. The length of the inlet chamber 7 in the overhang region $Ü_b$ and the core region $K_b$, in contrast, is V.

The inlet chamber 7 and the tube/fin block 2 can also be designed and connected to one another in such a manner that a number N of tube ends of the tube/fin block 2 project into the inlet chamber 7, or the inlet chamber 7 is fluidically connected to a number N of tube ends of the tube/fin block 2, wherein the number M of tube ends between the first baffle 11 and the second baffle 12 in proportion to N is in the range from 0.15 to 0.36, in particular is in the range from 0.21 to 0.33.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An evaporator for a refrigerant circuit of a motor vehicle, the evaporator comprising:

a tube/fin block with at least two tubes and fins;

a first collecting tank arranged on a first side of the tube/fin block;

a second collecting tank arranged on a second side of the tube/fin block;

an inlet chamber and an outlet chamber provided in the first collecting tank, the inlet chamber being provided with a refrigerant inlet connection and the outlet chamber being provided with a refrigerant outlet connection; and a first baffle and a second baffle arranged in the inlet chamber, the first and second baffles being arranged spaced apart from one another in the inlet chamber, wherein the first baffle is formed by a first wall with at least one first opening formed in the first wall and/or the second baffle is formed by a second wall with at least one second opening formed in the second wall.

2. The evaporator according to claim 1, wherein the at least one first opening has a first opening cross-sectional area, wherein the at least one second opening has a second opening cross-sectional area, and wherein the first opening cross-sectional area is smaller than the second opening cross-sectional area.

3. The evaporator according to claim 1, wherein the at least one first opening has an essentially circular opening or multiple circular openings and/or the at least one second opening has at least one or more essentially angular, quadrilateral, rectangular, or square opening.

4. The evaporator according to claim 2, wherein a plurality of first openings are provided that are equal in size or different in size with respect to the first opening cross-sectional area.

5. The evaporator according to claim 1, wherein the at least one first opening aligns with the at least one second opening.

6. The evaporator according to claim 1, wherein the at least one first opening on the first baffle is not covered at least partially by a projection of the second baffle.

7. The evaporator according to claim 1, wherein the at least one first opening includes two first openings that do not align with the at least one second opening.

8. The evaporator according to claim 7, wherein the two first openings on the first baffle are covered by a projection of the second baffle.

9. The evaporator according to claim 1, wherein the first collecting tank projects laterally past the tube/fin block with an overhang, wherein the first collecting tank is divided into an overhang region and a core region, wherein the overhang region projects laterally past the tube/fin block, and wherein the core region is located in the lateral extent of the tube/fin block.

10. An evaporator for a refrigerant circuit of a motor vehicle, the evaporator comprising:

a tube/fin block with at least two tubes and fins;

a first collecting tank arranged on a first side of the tube/fin block;

a second collecting tank arranged on a second side of the tube/fin block;

an inlet chamber and an outlet chamber provided in the first collecting tank, the inlet chamber being provided with a refrigerant inlet connection and the outlet chamber being provided with a refrigerant outlet connection; and a first baffle and a second baffle arranged in the inlet chamber, the first and second baffles being arranged spaced apart from one another in the inlet chamber, wherein the first collecting tank projects laterally past the tube/fin block with an overhang, wherein the first collecting tank is divided into an overhang region and a core region, wherein the overhang region projects laterally past the tube/fin block, and wherein the core region is located in the lateral extent of the tube/fin block, and wherein the refrigerant inlet connection of the inlet chamber and/or the refrigerant outlet connection of the outlet chamber is or are arranged in the overhang region of the first collecting tank.

11. The evaporator according to claim 9, wherein the first baffle is arranged in the inlet chamber at a transition between the overhang region and the core region.

12. The evaporator according to claim 9, wherein the second baffle is arranged in the core region of the inlet chamber.

13. An evaporator for a refrigerant circuit of a motor vehicle, the evaporator comprising:

a tube/fin block with at least two tubes and fins;

a first collecting tank arranged on a first side of the tube/fin block;

a second collecting tank arranged on a second side of the tube/fin block;

an inlet chamber and an outlet chamber provided in the first collecting tank, the inlet chamber being provided with a refrigerant inlet connection and the outlet chamber being provided with a refrigerant outlet connection; and a first baffle and a second baffle arranged in the inlet chamber, the first and second baffles being arranged spaced apart from one another in the inlet chamber, wherein the first collecting tank projects laterally past the tube/fin block with an overhang, wherein the first collecting tank is divided into an overhang region and a core region, wherein the overhang region projects laterally past the tube/fin block, and wherein the core region is located in the lateral extent of the tube/fin block, and wherein the inlet chamber has a lateral extent X, wherein a distance A between the first baffle and the second baffle, in proportion to the lateral extent X, is in a range from 0.15 to 0.36 or is in a range from 0.21 to 0.33.

14. The evaporator according to claim 9, wherein the inlet chamber and the tube/fin block are designed and connected to one another such that a number N of tube ends of the tube/fin block project into the inlet chamber or the inlet chamber is fluidically connected to a number N of tube ends of the tube/fin block, wherein a number M of tube ends between the first baffle and the second baffle in proportion to N is in a range from 0.15 to 0.36 or is in a range from 0.21 to 0.33.

15. The evaporator according to claim 1, wherein the first collecting tank is arranged above the second collecting tank.

* * * * *